US009556655B2

(12) United States Patent
Shimizu et al.

(10) Patent No.: US 9,556,655 B2
(45) Date of Patent: Jan. 31, 2017

(54) OUTER HANDLE DEVICE FOR VEHICLE DOOR

(71) Applicant: KABUSHIKI KAISHA HONDA LOCK, Miyazaki-Shi, Miyazaki (JP)

(72) Inventors: Norio Shimizu, Miyazaki (JP); Yasuyuki Etou, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 0 days.

(21) Appl. No.: 14/248,475

(22) Filed: Apr. 9, 2014

(65) Prior Publication Data

US 2014/0310916 A1 Oct. 23, 2014

(30) Foreign Application Priority Data

Apr. 22, 2013 (JP) ..... 2013-089237

(51) Int. Cl.
*E05B 3/00* (2006.01)
*E05B 85/16* (2014.01)
(Continued)

(52) U.S. Cl.
CPC ..... *E05B 85/16* (2013.01); *E05B 81/76* (2013.01); *E05B 81/77* (2013.01); *E05B 81/78* (2013.01); *Y10T 16/458* (2015.01)

(58) Field of Classification Search
CPC ..... E05B 81/76; E05B 81/77; E05B 81/78
(Continued)

(56) References Cited

U.S. PATENT DOCUMENTS 4,475,754 A * 10/1984 Arlauskas ..... E05B 85/16 292/336.3
6,234,041 B1 * 5/2001 Larabet ..... E05B 85/16 74/523
(Continued)

FOREIGN PATENT DOCUMENTS

CN 1713239 A 12/2005
DE 102006023634 A1 * 11/2007
(Continued)

OTHER PUBLICATIONS

Office Action issued in the corresponding Japanese Patent Application 2013-089237 dated Aug. 19, 2015.
(Continued)

*Primary Examiner* — Carlos Lugo
(74) *Attorney, Agent, or Firm* — Carrier Blackman & Associates, P.C.; Joseph P. Carrier; William D. Blackman

(57) ABSTRACT

An outer handle device for a vehicle door, in which a supporting arm portion provided on one end portion of an operating handle which houses an electronic component unit and is disposed on an outer side of the vehicle door is turnably supported by a base member fixed to the vehicle door, a groove housing part of a harness connected to the electronic component unit and routed from the operating handle into the vehicle door is provided in the supporting arm portion, and a guide portion holding the harness between the guide portion and the supporting arm portion is disposed to cover part of the groove, wherein the guide portion is formed integrally on the base member. Accordingly, the outer handle device can hold a harness while reducing the number of components.

6 Claims, 5 Drawing Sheets

(51) Int. Cl.
*E05B 81/76* (2014.01)
*E05B 85/10* (2014.01)
*E05B 81/78* (2014.01)

(58) Field of Classification Search
USPC ..... 292/336.3
See application file for complete search history.

(56) References Cited

U.S. PATENT DOCUMENTS

| | | | | |
|---|---|---|---|---|
| 6,543,090 | B2 * | 4/2003 | Muneta | 16/412 |
| 6,740,834 | B2 * | 5/2004 | Sueyoshi et al. | 200/600 |
| 6,883,840 | B2 * | 4/2005 | Sueyoshi et al. | 292/336.3 |
| 6,964,439 | B2 * | 11/2005 | Nomura et al. | 292/336.3 |
| 7,029,054 | B2 | 4/2006 | Kobayashi et al. | |
| 7,152,893 | B2 * | 12/2006 | Pudney | E05B 13/002 292/336.3 |
| 7,333,021 | B2 | 2/2008 | Ieda et al. | |
| 7,597,364 | B2 * | 10/2009 | Muneta | 292/80 |
| 7,654,147 | B2 * | 2/2010 | Witte et al. | 73/781 |
| 7,931,314 | B2 * | 4/2011 | Nitawaki et al. | 292/336.3 |
| 8,328,250 | B2 * | 12/2012 | Botten | E05B 79/06 277/644 |
| 8,601,903 | B1 * | 12/2013 | Klein et al. | 74/543 |
| 8,991,880 | B2 * | 3/2015 | Yokoyama et al. | 292/336.3 |
| 2003/0107473 | A1 * | 6/2003 | Pang et al. | 340/5.72 |
| 2007/0046080 | A1 * | 3/2007 | Muneta | 297/184.13 |
| 2012/0133563 | A1 * | 5/2012 | Naka | 343/713 |

FOREIGN PATENT DOCUMENTS

| | | | | |
|---|---|---|---|---|
| EP | 1674641 | A1 * | 6/2006 | |
| EP | 2330264 | * | 6/2011 | |
| JP | 2004-316164 | A | 11/2004 | |
| JP | 2014-189976 | A | 10/2014 | |
| WO | WO 2005038172 | A1 * | 4/2005 | E05B 1/00 |
| WO | WO 2006015631 | A1 * | 2/2006 | E05B 65/20 |

OTHER PUBLICATIONS

Official Communication issued in the corresponding Chinese patent application 201410154984.9 dated Nov. 26, 2015.

* cited by examiner

OUTER HANDLE DEVICE FOR VEHICLE DOOR

BACKGROUND OF THE INVENTION

Field of the Invention

The present invention relates to an outer handle device for a vehicle door, in which a supporting arm portion provided on one end portion of an operating handle which houses an electronic component unit and is disposed on an outer side of the vehicle door is turnably supported by a base member fixed to the vehicle door, a groove housing part of a harness connected to the electronic component unit and routed from the operating handle into the vehicle door is provided in the supporting arm portion, and a guide portion holding the harness between the guide portion and the supporting arm portion is disposed to cover part of the groove.

Description of the Related Art

Such an outer handle device for a vehicle door is known as disclosed in Japanese Patent Application Laid-open No. 2004-316164.

SUMMARY OF THE INVENTION

However, in the configuration of the outer handle device for a vehicle door according to Japanese Patent Application Laid-open No. 2004-316164, the guide member, which covers part of the groove provided in the supporting arm portion of the operation handle, in such a manner as to hold the harness, part of which is housed in the groove, between the guide member and the supporting arm portion, is formed as a member separate from the operating handle and the base member, and is attached to the supporting arm portion. For this reason, the number of components is increased.

The present invention has been made in view of the above-described circumstances, and an object of the present invention is to provide an outer handle device for a vehicle door, which can hold a harness while reducing the number of components.

In order to achieve the object, according to a first aspect of the present invention, there is provided an outer handle device for a vehicle door, in which a supporting arm portion provided on one end portion of an operating handle which houses an electronic component unit and is disposed on an outer side of the vehicle door is turnably supported by a base member fixed to the vehicle door, a groove housing part of a harness connected to the electronic component unit and routed from the operating handle into the vehicle door is provided in the supporting arm portion, and a guide portion holding the harness between the guide portion and the supporting arm portion is disposed to cover part of the groove, wherein the guide portion is formed integrally on the base member.

According to the first aspect of the present invention, the guide portion, which holds the harness between the guide portion and the supporting arm portion of the operating handle, is formed integrally on the base member, which is fixed to the vehicle door in such a manner as to turnably support the supporting arm member. Accordingly, it is possible to reduce the number of components by eliminating the need of a dedicated member for holding the harness between the dedicated member and the supporting arm portion. Moreover, the guide portion is caused to cover part of the groove and hold the harness between the guide portion and the supporting arm portion, only by mounting the supporting arm portion to the base member such that the supporting arm portion is turnably supported by the base member. Accordingly, the harness can be easily held, and the harness can thus be easily pulled out as compared to a configuration in which a penetration hole for inserting and holding the harness is provided in the supporting arm portion.

Note that a front base member 20 of an embodiment corresponds to the base member of the present invention.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described below on the basis of the attached drawings.

Figure 1:
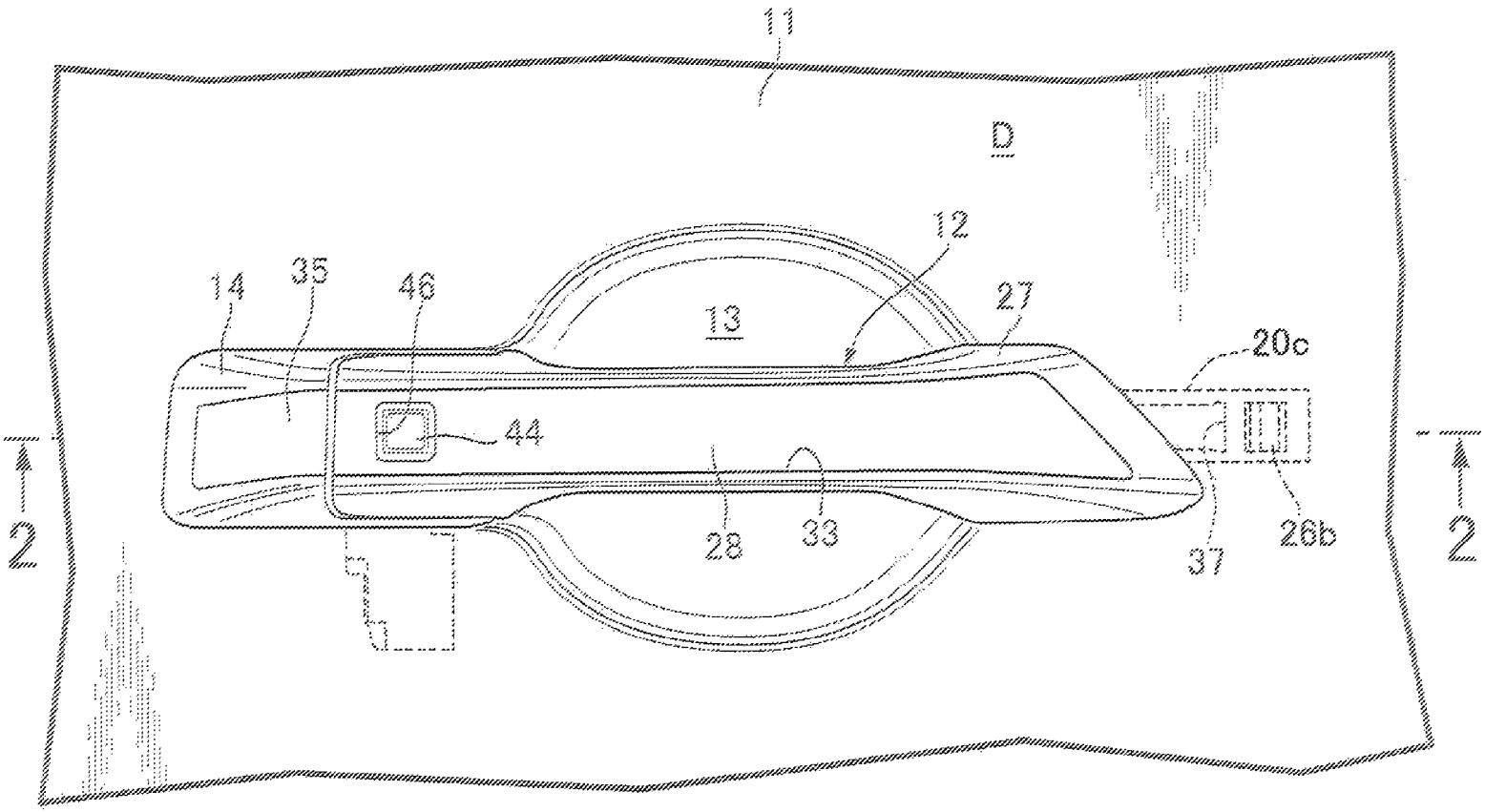
FIG. 1 is a partial side view of a vehicle door.
Figure 2:
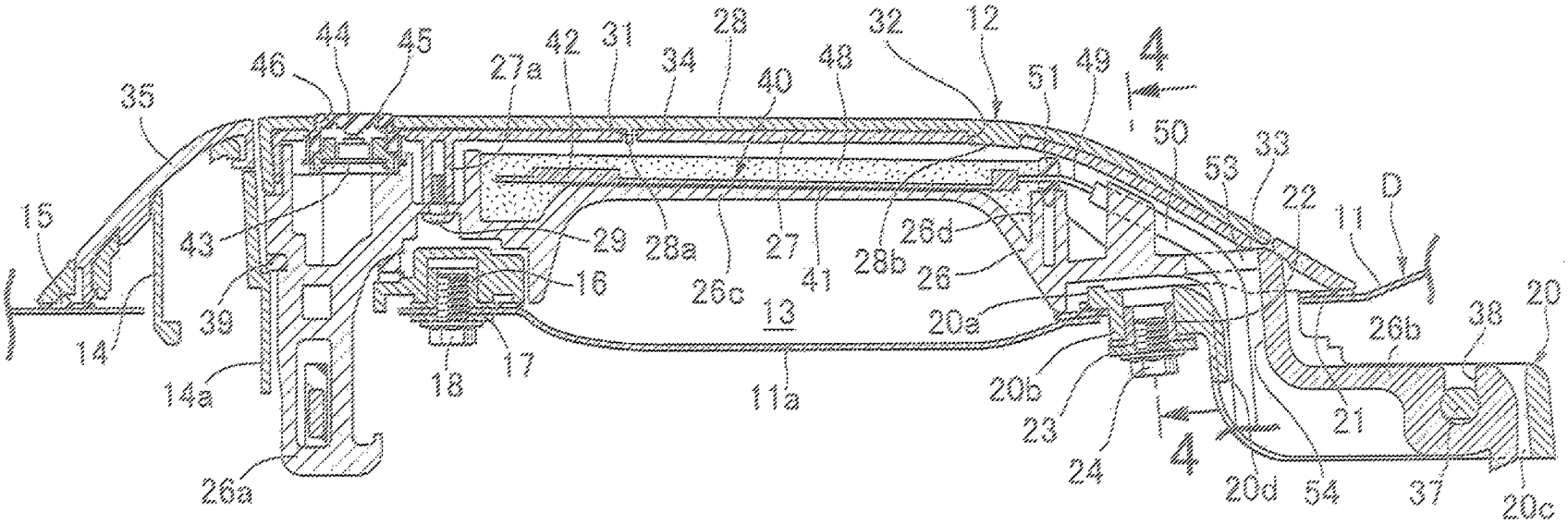
FIG. 2 is a sectional view taken along a line 2-2 in FIG. 1.

First, in FIGS. 1 and 2, an operating handle 12, which extends in a front-rear direction of a vehicle (a left-right direction in FIG. 1), is turnably attached to an outer panel 11 of a vehicle door D, which is a side door, for example, such that the operating handle 12 is capable of being operated on an outer side of the vehicle door D. In addition, a curved portion 11*a*, which forms a recess 13 for allowing a vehicle user to insert his or her hand for gripping the operating handle 12, is provided in the outer panel 11 in such a manner as to bulge inward in a vehicle-width direction.

A rear base member 14 is disposed rearward of the operating handle 12 in the front-rear direction of the vehicle with a seal member 15 interposed between the rear base member 14 and an outer face of the outer panel 11, the rear base member 14 rising outward from the outer panel 11 in such a manner as to be smoothly continuous with the operating handle 12 in a non-operated state. A nut 16 is press-fitted and fixed in the rear base member 14, which is formed of a hard synthetic resin. On the other hand, a first attachment member 17 is brought in contact with an inner face of the outer panel 11. The rear base member 14 and the first attachment member 17 are fixed to the outer panel 11 by screwing and fastening a bolt 18, which is inserted through the first attachment member 17 and the outer panel 11, into the nut 16. A guide tube portion 14*a*, which penetrates the outer panel 11 rearward of the recess 13 and extends inward of the outer panel 11, is provided integrally in the rear base member 14.

Figure 3:
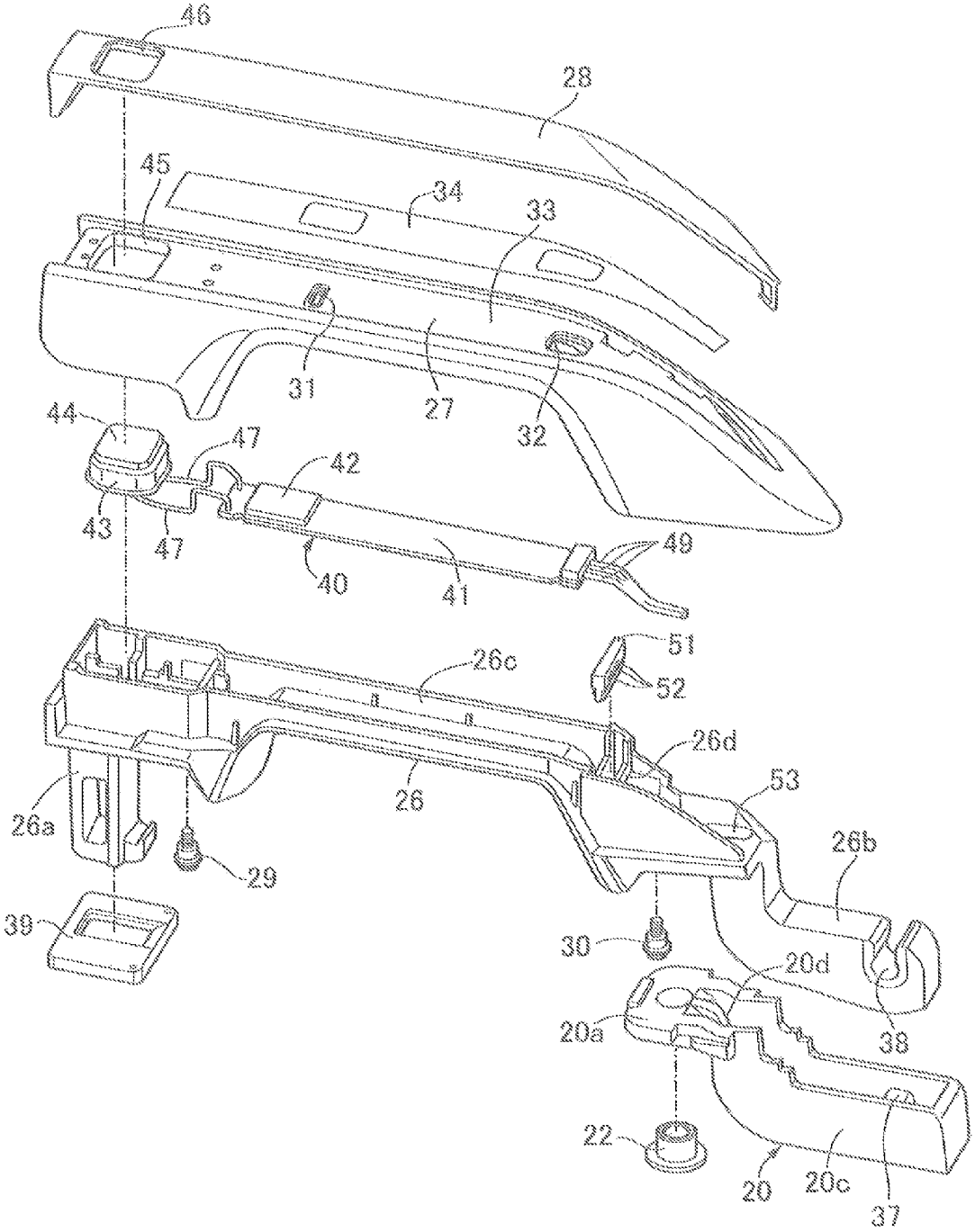
FIG. 3 is a perspective view showing a part of an outer handle device in an exploded manner.
Figure 4:
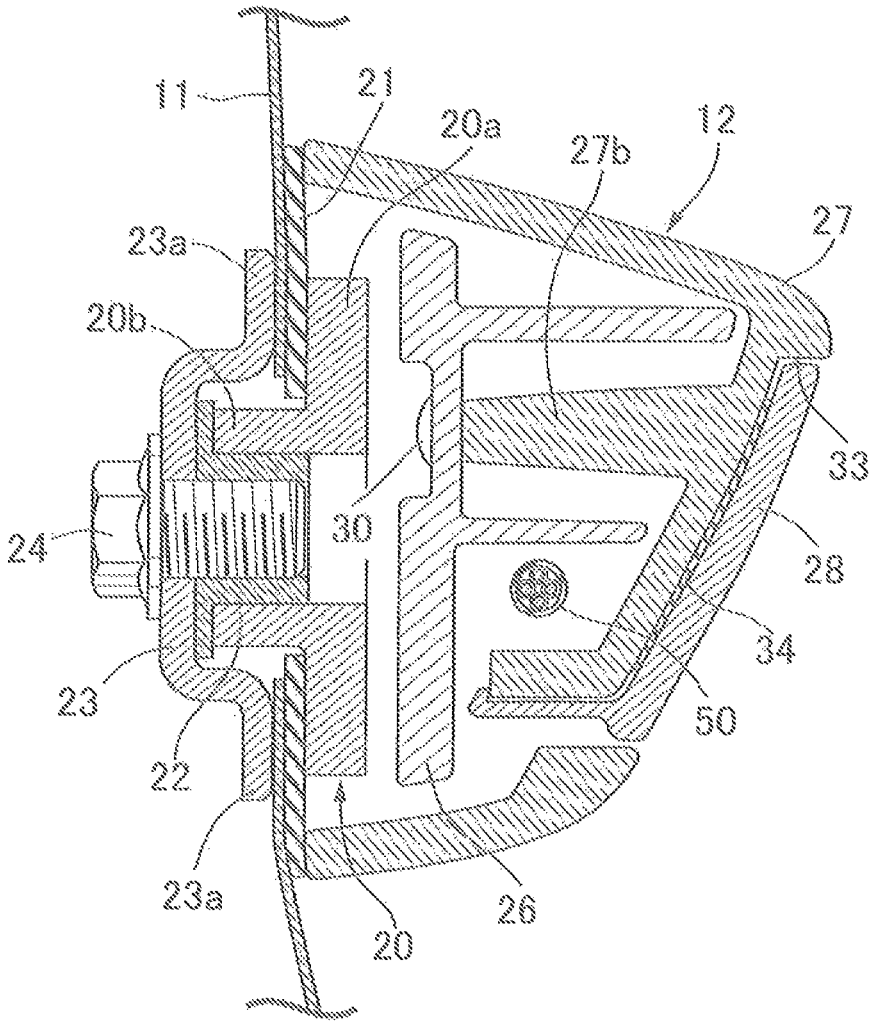
FIG. 4 is a sectional view taken along a line 4-4 in FIG. 2.

Referring FIGS. 3 and 4 as well, a front base member 20 made of a synthetic resin is disposed at a position overlapping a front portion of the operating handle 12, which extends along the front-rear direction of the vehicle, in a side view. The front base member 20 has: a flat plate-shaped attachment portion 20*a* with a seal member 21 interposed between the attachment portion 20*a* and the outer face of the outer panel 11; and a cylindrical boss portion 20*b* integrally continuous with the attachment portion 20*a* in such a manner as to penetrate the seal member 21 and the outer panel 11 and be protruded inward of the outer panel 11. A nut 22 is press-fitted and fixed in the boss portion 20*b*, and a second attachment member 23, which has a pair of leg portions 23*a* coming in contact with the inner face of the outer panel 11 so as to be formed in a substantially U-shape, is disposed in such a manner as to straddle the boss portion 20*b*. The front base member 20 and the second attachment member 23 are fixed to the outer panel 11 by screwing and fastening a bolt 24, which is inserted through the second attachment member 23, into the nut 22. In addition, a supporting portion 20*c*, which is bent into a substantially L-shape, is provided integrally on a front portion of the front base member 20 in such a manner as to be protruded inward of the outer panel 11.

The operating handle 12 includes: a handle body 26 which is formed of a synthetic resin, extends in the front-rear direction of the vehicle and is disposed on the outer face side of the outer panel 11; a handle cover 27 which is made of a synthetic resin and covers the handle body 26 from an opposite side from the vehicle door D; and a decorative member 28 which is attached in such a manner as to cover part of an outer surface of the handle cover 27.

A boss portion 27*a*, which projects to the handle body 26 side, is provided integrally on a rear portion of the handle cover 27, as shown in FIG. 2, while a boss portion 27*b*, which projects to the handle body 26 side, is provided integrally on a front portion of the handle cover 27, as shown in FIG. 4. The handle body 26 and the handle cover 27 are fastened to each other such that the handle body 26 is covered with the handle cover 27 from the opposite side from the vehicle door D, by screwing screw members 29, 30, which are inserted through the handle body 26, into the boss portions 27*a*, 27*b*.

In addition, the decorative member 28 is formed to cover part of a surface of the handle cover 27 and is plated. Fitting holes 31, 32, into which protrusions 28*a*, 28*b* provided on the decorative member 28 are fitted, are provided in the handle cover 27. In addition, a depressed portion 33, into which the decorative member 28 is fitted, is formed in the surface of the handle cover 27. The decorative member 28 with the protrusions 28*a*, 28*b* being fitted into the fitting holes 31, 32 is attached to the surface of the handle cover 27 while being fitted into the depressed portion 33, by use of a double-sided tape 34 interposed between the decorative member 28 and the handle cover 27.

In addition, as shown in FIG. 2, part of a surface of the rear base member 14 is also covered with another decorative member 35, which is plated. The decorative member 35 is engaged with and mounted on the rear base member 14.

An operating arm portion 26*a*, which is plunged into the guide tube portion 14*a* of the rear base member 14, is provided integrally on a rear end portion of the handle body 26. A supporting arm portion 26*b*, which is formed in a substantially L-shape to be plunged into the supporting portion 20*c* of the front base member 20, is provided integrally on a front end portion of the handle body 26.

A supporting depressed portion 38, which is fitted from below onto a supporting shaft 37 provided in the supporting portion 20*c* of the front base member 20, is provided in a tip end portion of the supporting arm portion 26*b*. The supporting arm portion 26*b* is turnably supported on the supporting portion 20*c* of the front base member 20 by fitting the supporting depressed portion 38 onto the supporting shaft 37.

In addition, the operating arm portion 26*a* is coupled to a latch mechanism, which is not shown. When the vehicle door D is in an unlocked state, operating the operating handle 12 in a direction to pull out the operating arm portion 26*a* outward of the vehicle door D causes the latch mechanism to release the vehicle door D from its closed state, thus making it possible to open the vehicle door D by operating the operating handle 12. Moreover, the operating handle 12 is configured such that the operating arm portion 26*a* is biased in a direction to be pulled inward of the vehicle door D by biasing means, which is not shown, and an elastic member 39, which surrounds the operating arm portion 26*a*, is mounted to the handle body 26 so as to mitigate an impact when the handle body 26 comes into contact with the rear base member 14.

A housing portion 26*c*, which has a substantially U-shaped cross-section and opens to the opposite side from the vehicle door D, is formed in the handle body 26. An electronic component unit 40, which is formed by disposing an electronic component 42 and the like on a circuit substrate 41, is housed in the housing portion 26*c*.

On the other hand, a lock switch 43 for confirming the vehicle user's intention to lock the vehicle door D is housed and fixed in a front portion of the handle body 26. A penetration hole 45, in which part of the lock switch 43 is disposed, is provided in the handle cover 27, and an opening portion 46 which a switch button 44 included in the lock switch 43 faces is provided in the decorative member 28. Moreover, the lock switch 43 is connected to the circuit substrate 41 of the electronic component unit 40 through a pair of conductive wires 47.

The electronic component unit 40 is housed in the housing portion 26*c*, and a potting agent 48, which covers the electronic component unit 40, is filled in the housing portion 26*c*.

A plurality of conductive wires 49 are led out from a front portion of the circuit substrate 41 in the electronic component unit 40. These conductive wires 49 are bundled into a harness 50. Moreover, a supporting wall portion 26*d* is provided on the handle body 26 on a front side of the electronic component unit 40, and a grommet 51, which is made of an elastic material and has a plurality of holding holes 52 through which the conductive wires 49 are individually inserted and held, is mounted to the supporting wall portion 26*d*.

Figure 5:
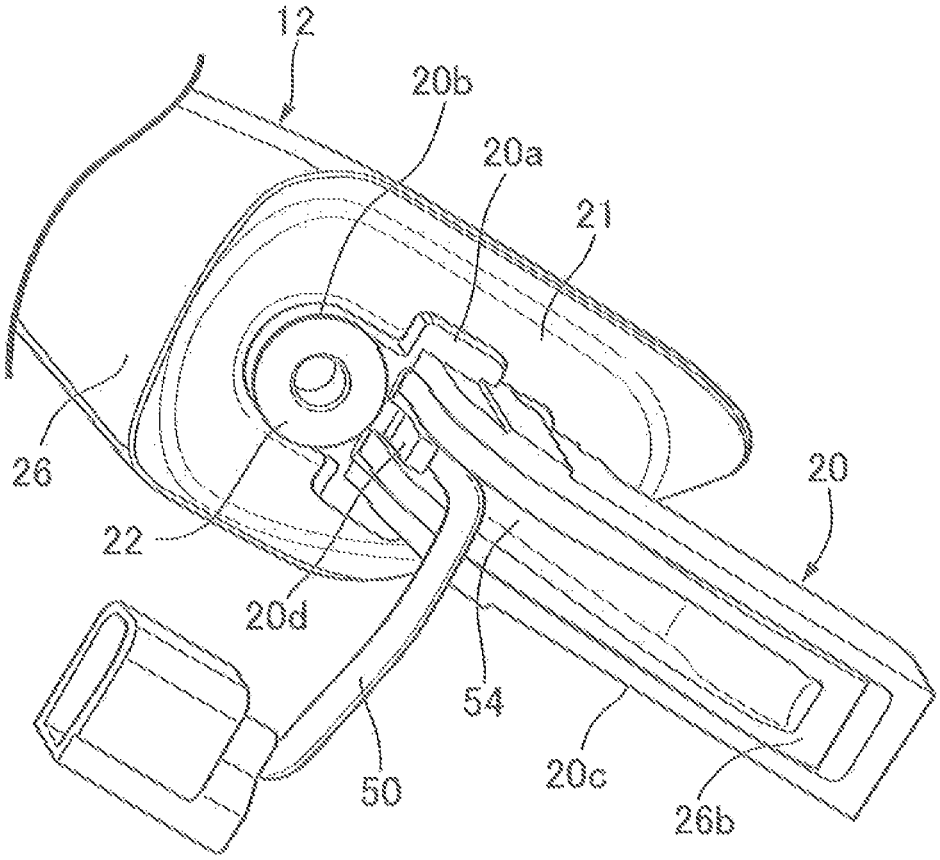
FIG. 5 is a perspective view of a pulled-out portion of a harness from a supporting arm portion of an operating handle as viewed from an inside of the vehicle door.

Referring to FIG. 5 as well, a lead-out hole 53, through which the harness 50 is led out to the outside, is provided in the front end portion of the handle body 26. A groove 54, which is open rearward and inward of the supporting arm portion 26*b*, is provided in the supporting arm portion 26*b*, which is integrally continuous with the front end portion of the handle body 26, such that the groove 54 is continuous to the lead-out hole 53. Part of the harness 50, which is connected to the electronic component unit 40 and routed from the operating handle 12 into the vehicle door D, is housed in the groove 54.

Moreover, a guide portion 20*d*, which holds the harness 50 between the guide portion 20*d* and the supporting arm portion 26*b*, is disposed in such a manner as to cover part of the groove 54. The guide portion 20*d* is formed integrally on the front base member 20 such that part of the guide portion 20*d* is inserted into the groove 54.

Next, operations of this embodiment will be described. The supporting arm portion 26*b*, which is provided on the front end portion of the operating handle 12 housing the electronic component unit 40, is turnably supported on the supporting portion 20*c* of the front base member 20 fixed to the outer panel 11 of the vehicle door D. The groove 54, which houses part of the harness 50 connected to the electronic component unit 40 and routed from the operating handle 12 into the vehicle door D, is provided in the supporting arm portion 26*b*. The guide portion 20*d*, which covers part of the groove 54 while holding the harness 50 between the guide portion 20*d* and the supporting arm portion 26*b*, is formed integrally on the front base member 20. Accordingly, it is possible to reduce the number of components by eliminating the need of a dedicated member for holding the harness 50 between the dedicated member and the supporting arm portion 26*b*. Moreover, the guide portion 20*d* is caused to cover part of the groove 54 and hold the harness 50 between the guide portion 20*d* and the supporting arm portion 26*b*, only by mounting the supporting arm portion 26*b* to the front base member 20 such that the supporting arm portion 26*b* is turnably supported by the front base member 20. Accordingly, the harness 50 can be easily held, and the harness 50 can thus be pulled out easily as compared to a configuration in which a penetration hole for inserting and holding the harness 50 is provided in the supporting arm portion 26*b*.

Although the embodiment of the present invention has been described so far, the present invention is not limited to the above-described embodiment, and various modifications in design can be made without departing from the present invention described in claims.

What is claimed is:

1. An outer handle device for a vehicle door, in which a supporting arm portion provided on one of opposite end portions of an operating handle which houses an electronic component unit and is disposed on an outer side of the vehicle door is turnably supported by a base member fixed to the vehicle door, a groove housing part of a harness connected to the electronic component unit and routed from the operating handle into the vehicle door is provided in the supporting arm portion, and a guide portion holding the harness between the guide portion and the supporting arm portion is disposed to cover part of the groove, wherein the groove is open toward an other of opposite end portions of the operating handle and inward of the operating handle, the guide portion is formed integrally on the base member such that part of the guide portion is inserted into the groove, the guide portion projects only partially into the groove such that a gap is defined between an end face of the guide portion and a surface of the groove, and a width of the gap is at least as large as a width of the part of the harness provided in the supporting arm portion.

2. The outer handle device for a vehicle door according to claim 1, wherein the base member is fixed to an outer panel of the vehicle door using a fastener that directly engages the base member and the outer panel.

3. The outer handle device for a vehicle door according to claim 2, wherein the base member is disposed adjacent to the outer panel with only a planar seal member disposed therebetween.

4. The outer handle device for a vehicle door according to claim 1, wherein the base member is disposed only at the one end portion of the operating handle.

5. The outer handle device for a vehicle door according to claim 1, wherein the guide portion projects from a surface of the base member into the groove of the supporting arm portion.

6. The outer handle device for a vehicle door according to claim 1, wherein the base member has a hollow recessed portion, and the supporting arm portion is disposed in the hollow recessed portion and pivotally connected thereto.

* * * * *